US008016623B2

(12) United States Patent
Ju

(10) Patent No.: US 8,016,623 B2
(45) Date of Patent: Sep. 13, 2011

(54) SOCKET TERMINAL FOR GRID ARRAY CONNECTOR

(75) Inventor: Ted Ju, Keelung (TW)

(73) Assignee: Lotes Co., Ltd, Keelung (TW)

( * ) Notice: Subject to any disclaimer, the term of this patent is extended or adjusted under 35 U.S.C. 154(b) by 207 days.

(21) Appl. No.: 12/468,319

(22) Filed: May 19, 2009

(65) Prior Publication Data

US 2010/0297866 A1 Nov. 25, 2010

(51) Int. Cl.
*H01R 11/22* (2006.01)

(52) U.S. Cl. ..... 439/856; 439/342

(58) Field of Classification Search ..... 439/342, 439/856, 857, 83
See application file for complete search history.

(56) References Cited

U.S. PATENT DOCUMENTS 6,530,788 B1 * 3/2003 Ju ..... 439/83
6,702,594 B2 * 3/2004 Lee et al. ..... 439/83
6,824,414 B2 * 11/2004 Whyne et al. ..... 439/342
7,682,165 B2 * 3/2010 Liao ..... 439/83
7,828,562 B2 * 11/2010 Wu ..... 439/83
7,828,578 B1 * 11/2010 Ju ..... 439/342
2006/0258190 A1 * 11/2006 Chen ..... 439/83
2006/0258191 A1 * 11/2006 Chen ..... 439/83

* cited by examiner

*Primary Examiner* — Edwin A. Leon
*Assistant Examiner* — Vanessa Girardi
(74) *Attorney, Agent, or Firm* — Ming Chow; Sinorica, LLC

(57) ABSTRACT

Disclosed is a socket terminal for grip array connector, including a plurality of conductive terminals. The conductive terminal comprises a base and a pair of arms. Each arm includes a connection part extending forwardly from the base, a first bending part bent and extending upwardly from the connection part, a second bending part bent upwardly from the first bending part, a first elastic arm extending upwardly from the second bending part, and a contact section formed at a rear end of the first elastic arm. The first bending part bends away from the other arm and the second bending part locates away from the other arm while the first elastic arm extends toward the other arm. The minimum distance between the two first elastic arms and that between the two second bending parts are larger than the minimum distance between the two connection parts and that between the two contact sections.

25 Claims, 7 Drawing Sheets

SOCKET TERMINAL FOR GRID ARRAY CONNECTOR

BACKGROUND OF THE INVENTION

1. Field of Invention

The present invention relates to an electrical connector, especially to a socket terminal for grip array connector, and connecting chip modules with circuit boards.

2. Description of Related Art

Along with prosperous development of electronic industries, electrical connectors have become more important and with broader applications in this field. Thus there are two important factors for people in this field to select proper electrical connectors-performance and cost of the electrical connector. Some other issues are also taken into considerations such as how to provide better electrical connection between the terminals of the electrical connector and electronic components/circuit boards, how to reduce cost of electrical connectors and improved manufacturing efficiency, and factors that affect performance or cost of the electrical connector. One of the factors is the shape and structure of the terminal of the electrical connectors.

Refer to Chinese Pat. No. 01279922, a conductive terminal of electrical connectors is disclosed. The conductive terminal includes a base and two arms. The base includes a main body and a welding part that connects a conductive terminal of the electrical connector to a circuit board. The two arms are bent from two opposite sides of the main body. Each arm consists of a connection part extending upwardly from the main body and disposed on opposite sides, a contact part arranged at a rear end of the connection part, and a guiding part extending from one side of the contact part near the main body. A receiving space is formed between the two connection parts. The two connection parts are parallel while extending upward and the two contact parts are also parallel to each other. Pins of chip modules are toward the contact part by the guiding of the guiding part so as to electrically connect with the conductive terminal of the electrical connector.

The two connection parts are parallel while extending upward and the two contact parts are also parallel to each other. The two contact parts are respectively formed at a rear end of the each connection parts so that the distance between the two contact parts is the same with the distance between the two connection parts.

The above conductive terminal of the electrical connector has following shortcomings:

1. Because the distance between the two contact parts is the same with the distance between the two connection parts, the pin size can only be smaller or equal to the distance between the two connection parts.
2. The sharp end of the pin is easy to scratch inner walls of the two arms and cause damages of the pin as well as the conductive terminal of the electrical connector. Thus both the electrical connection between the conductive terminal of the electrical connector and the chip module, and the electrical connection between the conductive terminal of the electrical connector and the circuit board are further affected.

Refer to U.S. Pat. No. 6,319,038, a contact (terminal) for another connector is revealed. The contact includes a base, a pair of contact regions for electrically connected with a chip module and a pair of arm sections extending from the base. Each arm section comprises an upper arm extending from the base, a forearm extending from a free end of the upper arm for connecting the upper arm with a contact region, and a palm extending from the contact region toward the base. The distance between the pair of forearms is smaller than the distance between the two upper arms but larger than the distance between the two contact regions.

When the conductive terminals are aligned on a metal band and the pair of arms is in the same plane as the base, the two arms are totally formed by bending of material on left and right sides of the base inwards. Thus the width of each conductive terminal occupied on the metal band is increased. That means the distance between central lines of two contiguous conductive terminals is increased and the total extended area of the conductive terminal is enlarged. During the assembling processes, the conductive terminal is assembled into the terminal receiving slot with the metal band in an alignment. Under the limit of the shape of the conductive terminal of the electrical connector, the distance of the above two contiguous conductive terminals is unable to be reduced or adjusted according to the distance between central lines of the two contiguous terminal receiving slots.

According to the above structure, when the pins of the chip module connect with the conductive terminal of the electrical connector, the pin size can be adjusted properly because the distance between the pair of upper arms is larger than the distance between the two contact regions. At the same time, the sharp end of the pin will not damage inner walls of the two upper arms so that damages of pins and of conductive terminals can be avoided.

Although the above conductive terminal solves the problems of damages of pins as well as the conductive terminal, such design still has some disadvantages:

1. Considering the cost, the material is wasted because the two arms are totally formed by material on left and right sides of the base and then being bent inwards. Furthermore, the distance between the central lines of two contiguous conductive terminals of electrical connectors is increased.
2. In consideration of time: during the assembling processes, the conductive terminals of the electrical connector connected with the metal band are assembled into the terminal receiving slot in a line. Under the limit of the shape of the conductive terminal, the distance of the above two contiguous conductive terminals is unable to be reduced along with the shortened distance between central lines of the two contiguous terminal receiving slots. This increases the level of difficulty in assembling and reduces the efficiency of stamping as well as assembling. Thus the manufacturing cost is increased.

Thus is a need to design a novel electrical connector to overcome the shortcomings mentioned above.

SUMMARY OF THE INVENTION

Therefore it is a primary object of the present invention to provide an socket terminal that provides good electrical connection among a conductive terminal, chip module and a circuit board. Moreover, the design of the electrical connector is easily assembled and material saving.

Moreover, it is another object of the present invention to provide an socket terminal in which a conductive terminal has higher elasticity so as to provide better hold and contact.

In order to achieve above objects, a socket terminal for grip array connector of the present invention includes a base, a connection part extending forwardly from each side of the base, and a pair of arms respectively bent from one side of the connection part and extending upward. Each arm includes a first bending part, a second bending part, a first elastic arm, and a contact section. The first bending part is bent and extends upwardly from the connection part and its extension direction on each arm is away from the other arm. The second bending part is bent upwardly from the first bending part, and the second bending part on each arm locates away from the other arm. The first elastic arm extends upwardly from the second bending part and extends toward the other arm. The contact section is formed at a rear end of the first elastic arm and corresponding to the other contact section of the other arm. The welding part extends downwardly from the base. The fixing part extends from the welding part. Both the welding part and the fixing part are in the same plane as the base.

A socket terminal for grip connector has a base, a pair of arms respectively bent from two sides of the base and extending upward. Each arm includes a connection part, a first bending part, a second bending part, a first elastic arm, and a contact section. The connection part extends forwardly from the side of the base. The first bending part is bent and extends upwardly from the connection part and its extension direction on each arm is away from the other arm. The second bending part is bent upwardly from the first bending parts, and the second bending part on each arm locates from the other arm. The first elastic arm extends upwardly from the second bending part and extends toward the other arm. The contact section is formed at a rear end of the first elastic arm and corresponding to the other contact section of the other arm. The welding part extends downwardly from the base. The fixing part extends from the welding part. Both the welding part and the base are in the same plane.

A socket terminal for grip array connector has a base, a pair of arms respectively bent from two sides of the base and extending upwardly. Each arm includes a connection part, a first bending part, a second bending part, a first elastic arm, and a contact section. The connection part extends forwardly from the side of the base. The first bending part is bent and extends upwardly from the connection part and its extension direction on each arm is away from the other arm. The second bending part is bent upwardly from the first bending part, and the second bending part on each arm locates away from the other arm. The first elastic arm extends upwardly from the second bending part and extends toward the other arm. The contact section is formed at a rear end of the first elastic arm and corresponding to the other contact section of the other arm. The welding part extends downward from the base. The fixing part extends from the welding part. Both the fixing part and the base are in the same plane.

Compared with the prior art, the electrical connector of the present invention includes following advantages:

1. Due to the condition that the minimum distance between the two fixing parts and that of the two second bending parts are both larger than the minimum distance between the two connection parts as well as that of the two contact sections, damages of the pins of the chip module as well as of the conductive terminals can be avoided. Thus a better electrical connection is provided.
2. The distance between the central lines of the two contiguous terminals on a material band is the same with the distance between the central lines between the two terminal receiving slots of the electrical connector for receiving the terminal. Thus not only the material is saved but the assembling of the conductive terminals is also more convenient and easier.
3. When the fixing part, the welding part and the base are all in the same plane, the processing procedures such as bending are reduced. Thus stamping and processing of products are simplified, the efficiency is improved and the cost is reduced. In the same way, when only the base and the fixing part are in the same plane, or only the base and the welding part are in the same plane, or only the fixing part and the welding part are in the same plane, the same effects can also be achieved.
4. Both the first bending part and the second bending part on each arm are bent and located away from the other arm while the first elastic is bent and extends toward the other arm. Thus the elasticity and strength of the conductive terminal are improved and the conductive terminal will not make the pin bend and deform. Moreover, the clip-retaining strength of the contact section toward the pin of the chip module is increased so as to provide better hold and contact between the conductive terminal and the pin of the chip module.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
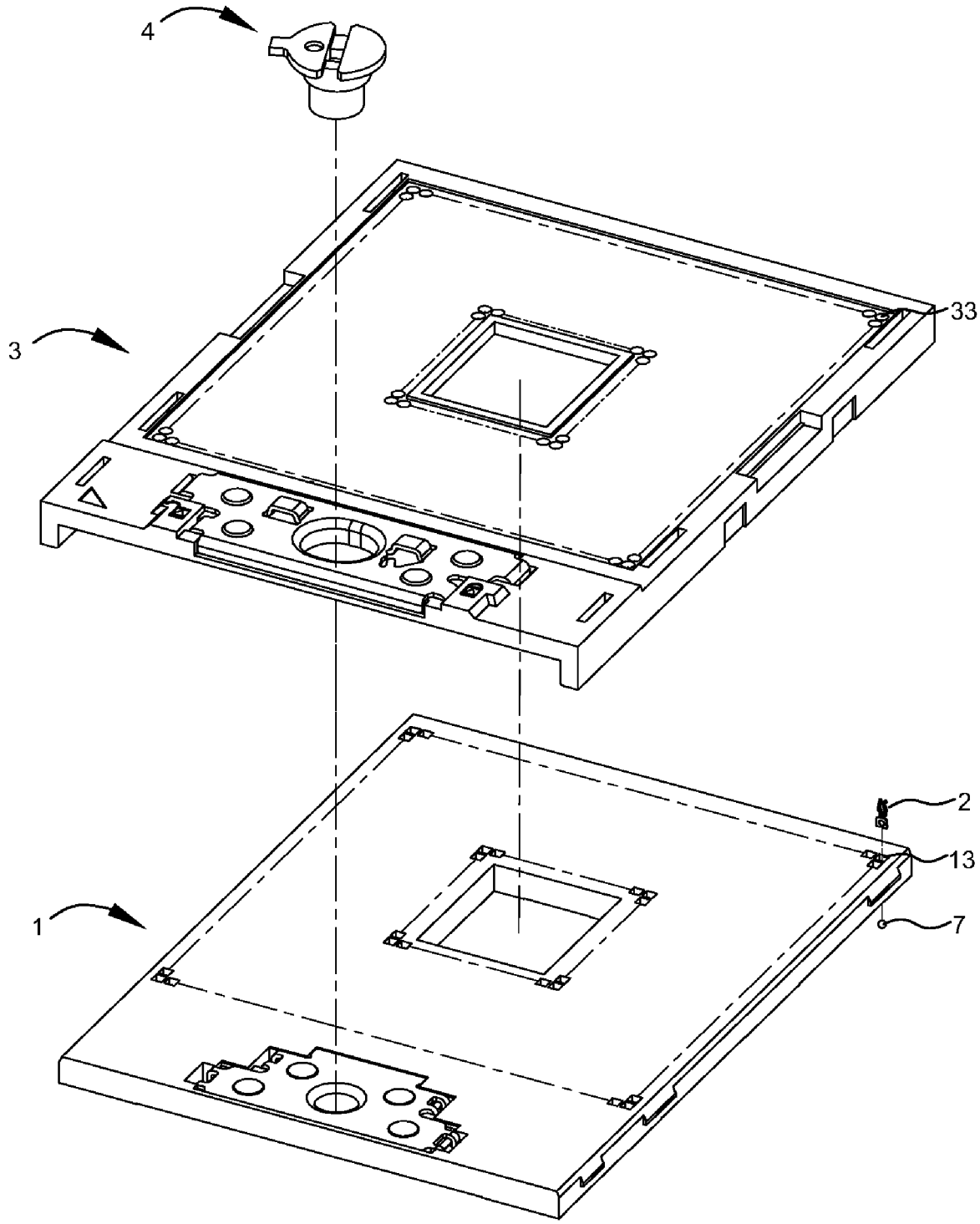
FIG. 1 is an explosive view of an embodiment of an electrical connector according to the present invention.

Refer to FIG. 1, a socket terminal for grip array connector of the present invention includes an insulative body 1, a plurality of conductive terminals 2 fixed in the insulative body 1, a top cover 3 that being slibale over the insulative body 1, and a driving member 4 that drives the top cover 3 to slide along the insulative body 1.

Figure 2:
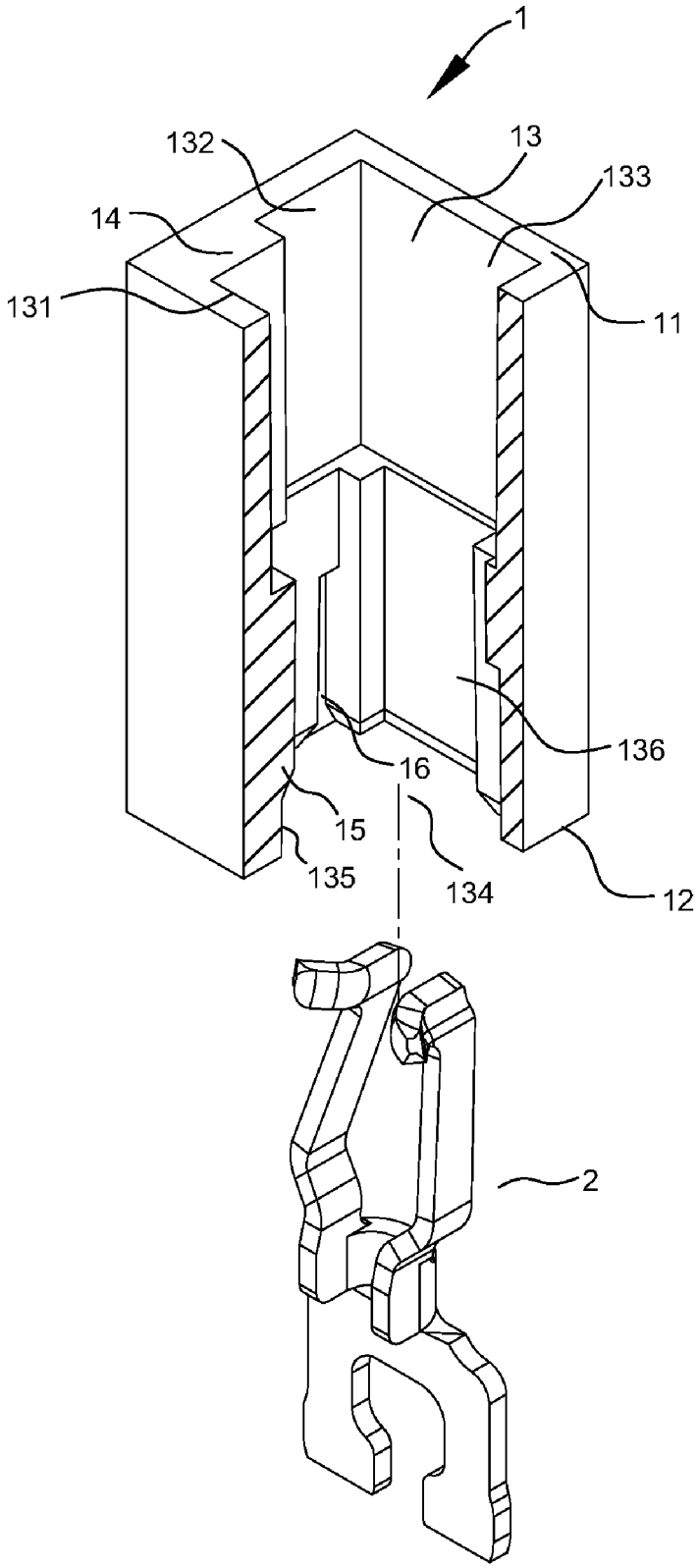
FIG. 2 is a an explosive view showing a terminal receiving slot of an electrical connector and a conductive terminal.

Refer to FIG. 2, the insulative body 1 has an upper surface 11 and a lower surface 12 arranged corresponding to each other, and a plurality of terminal receiving slots 13 penetrating the upper surface 11 and the lower surface 12.

The terminal receiving slot 13 is composed of a first side wall 131, two second side walls 132 beside the first side wall 131, a third side wall 133 beside the second side wall 132. The first side wall 131 and the third side wall 133 are disposed opposite to each other. Moreover, a receiving space 134 is formed at one end of the terminal receiving slot 13, near the lower surface 12.

A projecting block 14 is disposed projectingly toward the terminal receiving slot 13, on a contact area between the first side wall 131 and the second side wall 132 for preventing the conductive terminal 2 moving toward the first side wall 131. A stopping part 15 is arranged projectingly toward the receiving space 134 on the first side wall 131, near the lower surface 12. The bottom of the stopping part 15 forms a stopping surface 151. A leaning surface 135 is located on the first side wall 131, near the lower surface 12 and under the stopping part 15. Part of the second side wall 132, near the third side wall 133, dents inward to form a fixing slot 16 for fixing the conductive terminal 2. A buffering space 136 is formed by a concave area on the third side wall 133 and is corresponding to the leaning surface 135. The buffering space 136 is a space that allows elastic deformation of the conductive terminal 2.

Back to FIG. 1, the top cover 3 is slidable over the insulative body 1 horizontally. A plurality of insertion holes 33 (part shown in figure) corresponding to the terminal receiving slots 13 are arranged in the top cover 3. The driving member 4 is used to drive the top cover 3 sliding along the insulative body 1 horizontally so as to make the insertion holes 33 correspond to the terminal receiving slots 13.

Figure 3:
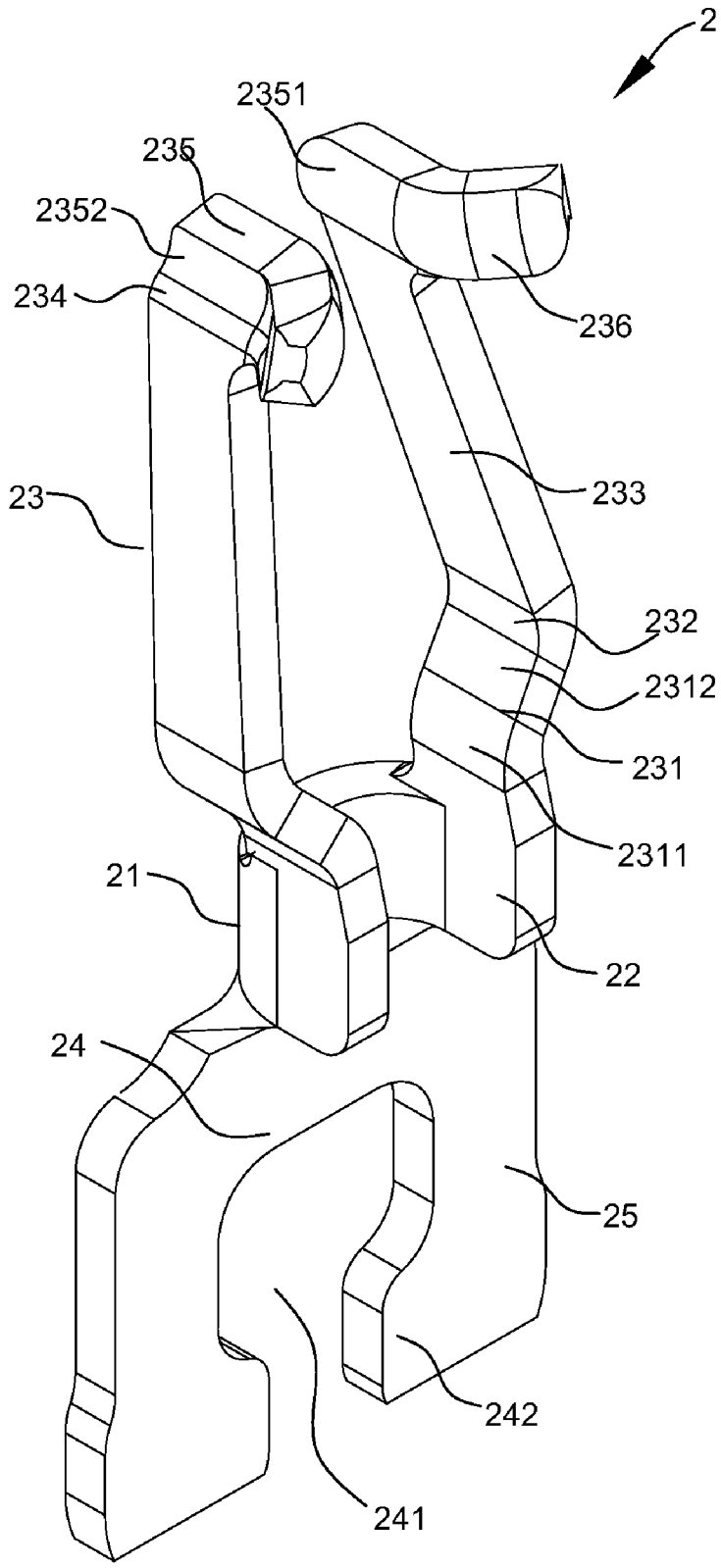
FIG. 3 is a perspective view of a conductive terminal of an electrical connector according to the present invention.
Figure 4:
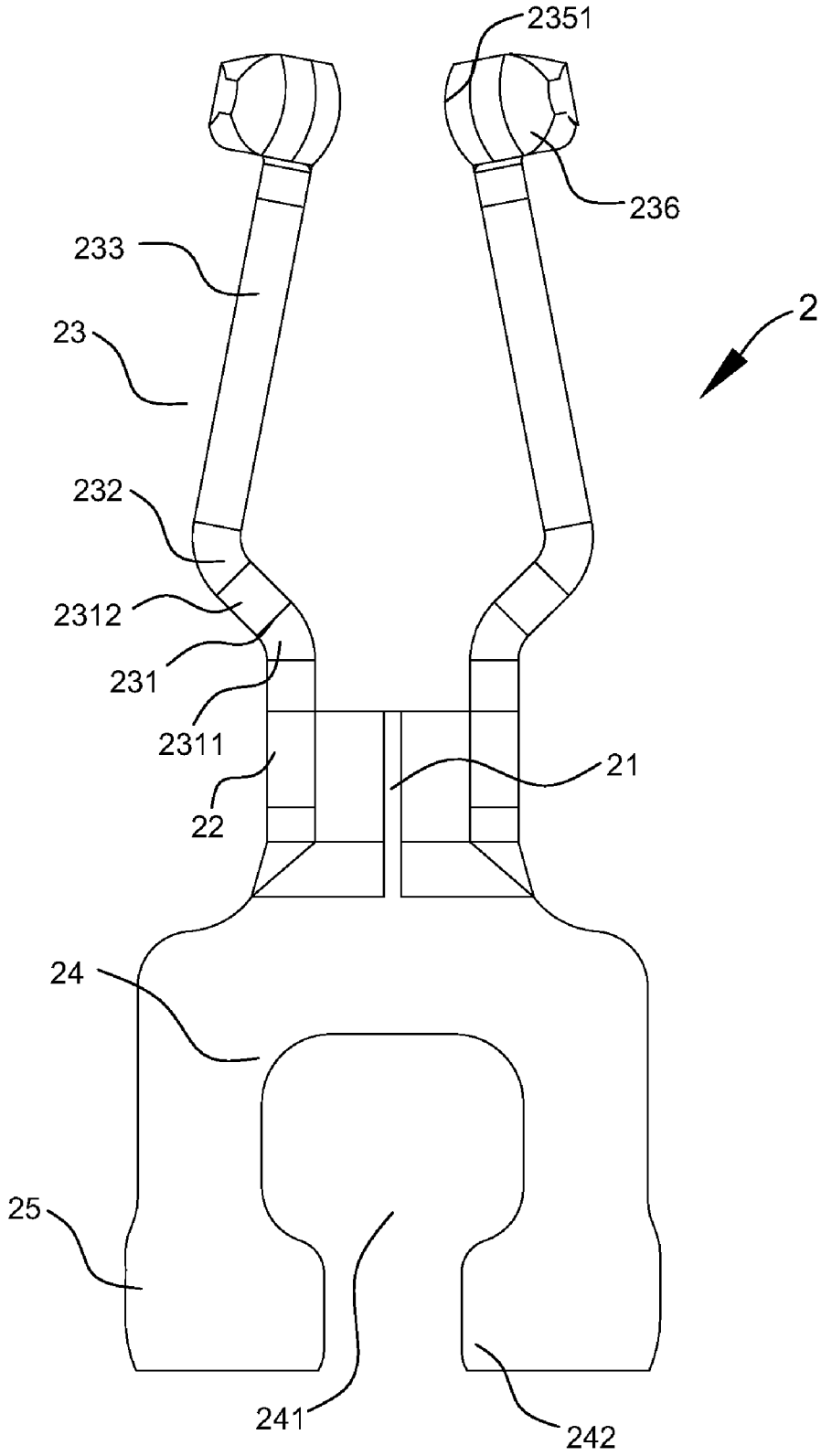
FIG. 4 is a schematic drawing showing a conductive terminal of an electrical connector according to the present invention.

Refer to FIG. 3 & FIG. 4, the plurality of conductive terminals 2 are received in the plurality of the terminal receiving slots 13. Each conductive terminal 2 includes a base 21 that is mounted in the terminal receiving slot 13 and a connection part 22 extending from each side of the base 21. A pair of arms 23 is bent from one side of the connection part 22 and extends upward. The connection part 22 connects the base 21 with the arm 23. Each arm 23 consists of a first bending part 231 that is bent and extends upwardly from the connection part 22, a second bending part 232 that is bent upwardly from the first bending part 231, a first elastic arm 233 that extends upwardly from the second bending part 232, a third bending part 234 that is bent upwardly from the first elastic arm 233, and a contact section 235 at a rear end of the first elastic arm 233 and corresponding to the other contact section 235 of the other arm 23. A contact surface 2351 is located on one side of the contact section 235 that faces the other contact section 235 while an arched slot 2352 is formed on the other side of the contact section 235. And a guiding part 236 at a rear end of the contact section 235 extends forward horizontally, away from the base 21. The two guiding parts 236 extend away from each other. The first bending part 231 further includes a bending member 2311 and a second elastic arm 2312 extending upwardly from the bending member 2311.

The two arms 23 are disposed correspondingly. The bending member 2311, the second elastic arm 2312 and the second bending part 232 are all bent and extending in the direction that is away from the other arm 23 while the first elastic arm 233, the third bending part 234 are extending and bent in the direction toward the other arm 23. Furthermore, a free end of each contact surface 2351 extends in the direction away from each other.

A welding part 24 extends from the base 21 downward and includes an open slot 241 so that the welding part 24 has two elastic pressing parts 242 respectively located on two sides thereof. Moreover, the welding part 24 is in the same plane as the base 21.

At least one fixing part 25 extending from the welding part 24 is received and fixed in the fixing slot 16. The fixing part 25 is also in the same plane as the welding part 24.

The minimum width between the two fixing parts 25 is larger than the minimum distance between the two second bending parts 232 while the minimum distance between the two second bending parts 232 is larger than the distance between the two connection parts 22. The distance between the two connection parts 22 is larger than the minimum distance between the two contact sections 235, as shown in FIG. 4.

In other embodiments, the distance may be modified. The minimum width between the two fixing parts 25 is larger than the minimum distance between the two second bending parts 232. The minimum distance between the two second bending parts 232 is larger than the minimum distance between the two contact sections 235. The minimum distance between the two contact sections 235 is larger than the distance between the two connection parts 22.

Figure 5:
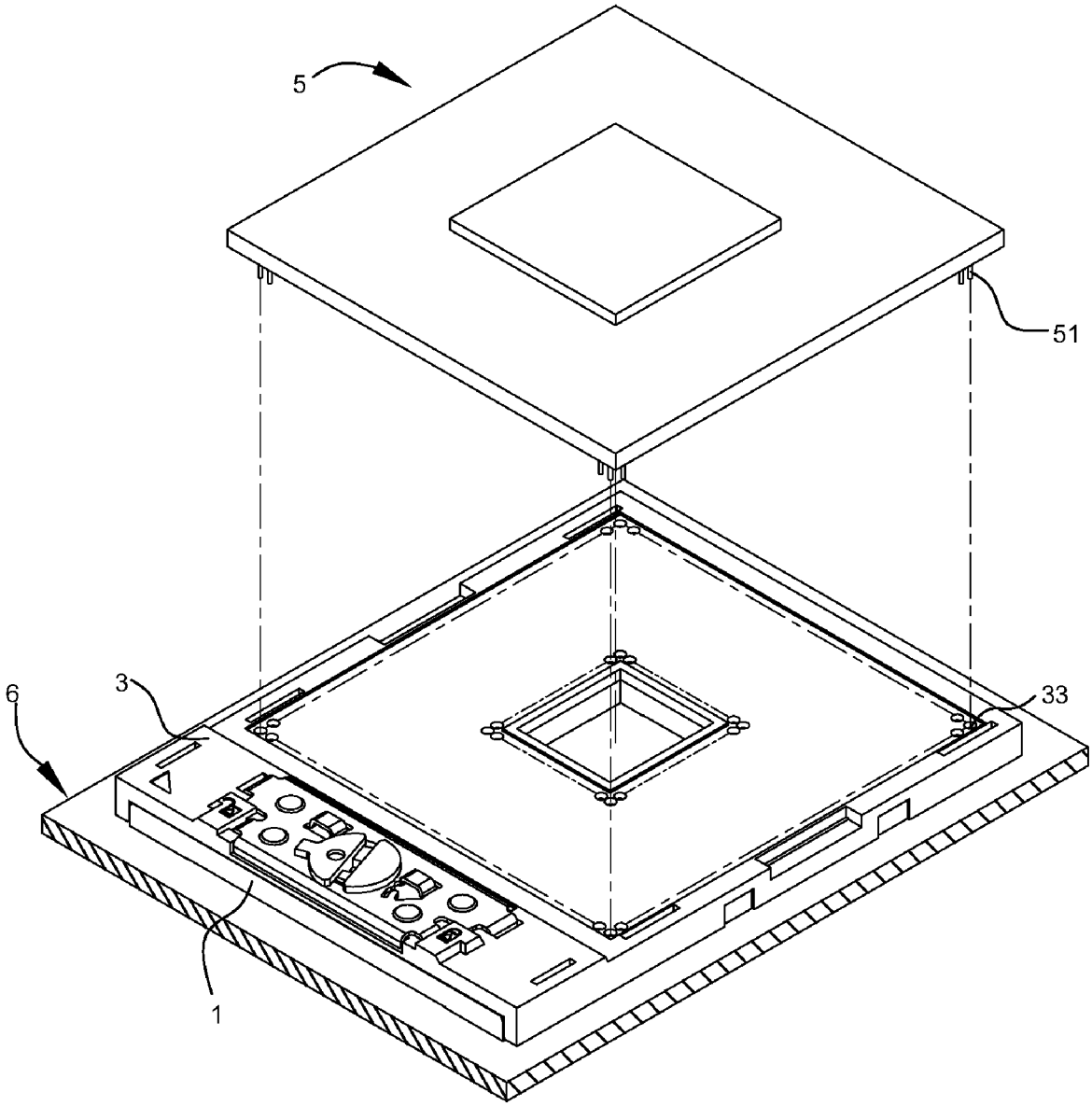
FIG. 5 is an assembling view of an electrical connector, a chip module and a circuit board.

Refer to FIG. 5, while in operation, the socket terminal is used to electrically connect a chip module 5 with a circuit board 6. The chip module 5 includes a plurality of pins 51 so as to connect with the socket terminal while the socket terminal is welded on the circuit board 6 by a plurality of solder balls 7.

Figure 6:
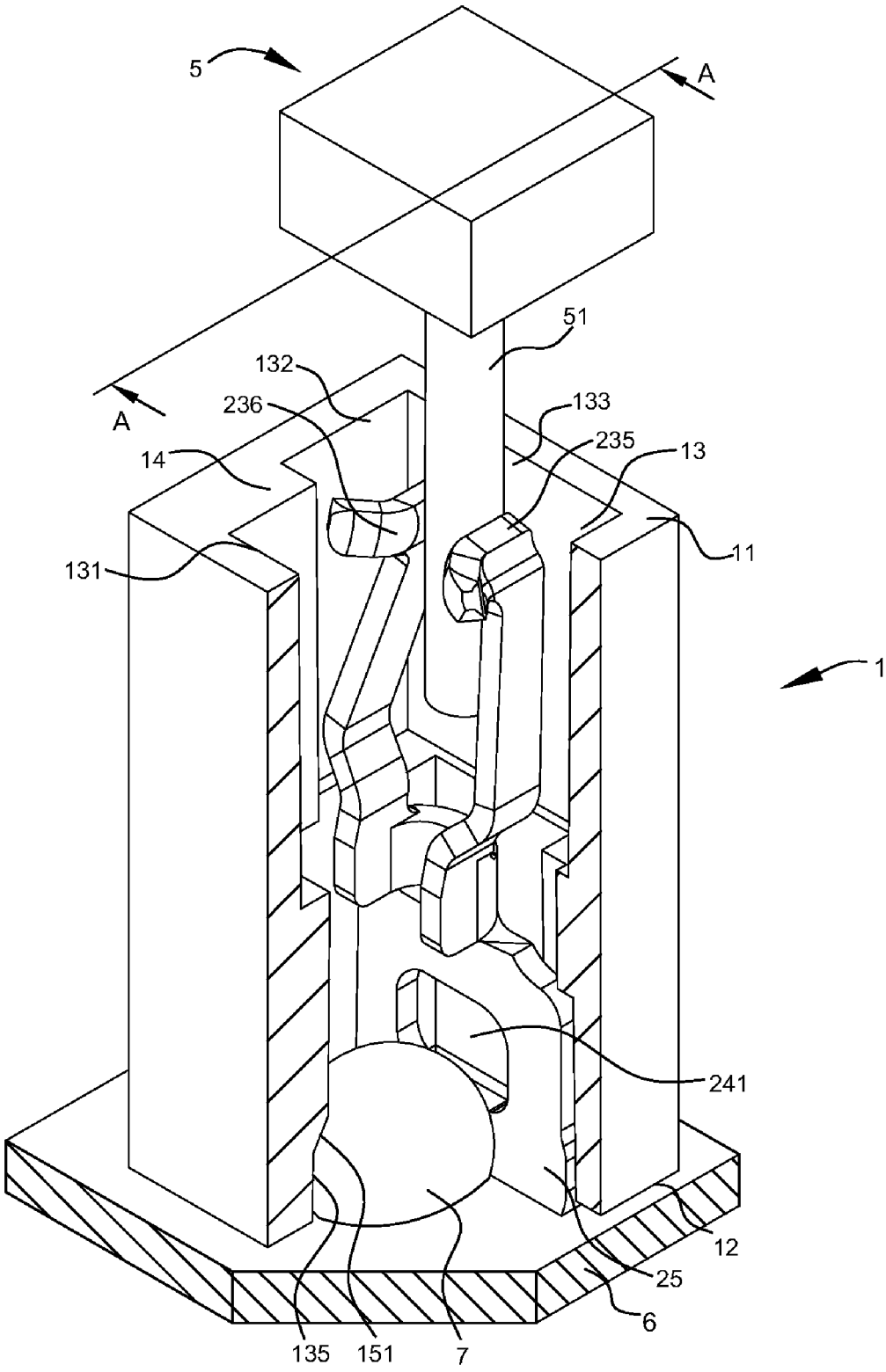
FIG. 6 is a schematic drawing showing the assembling between a terminal of the electrical connector and a pin of the chip module.
Figure 7:
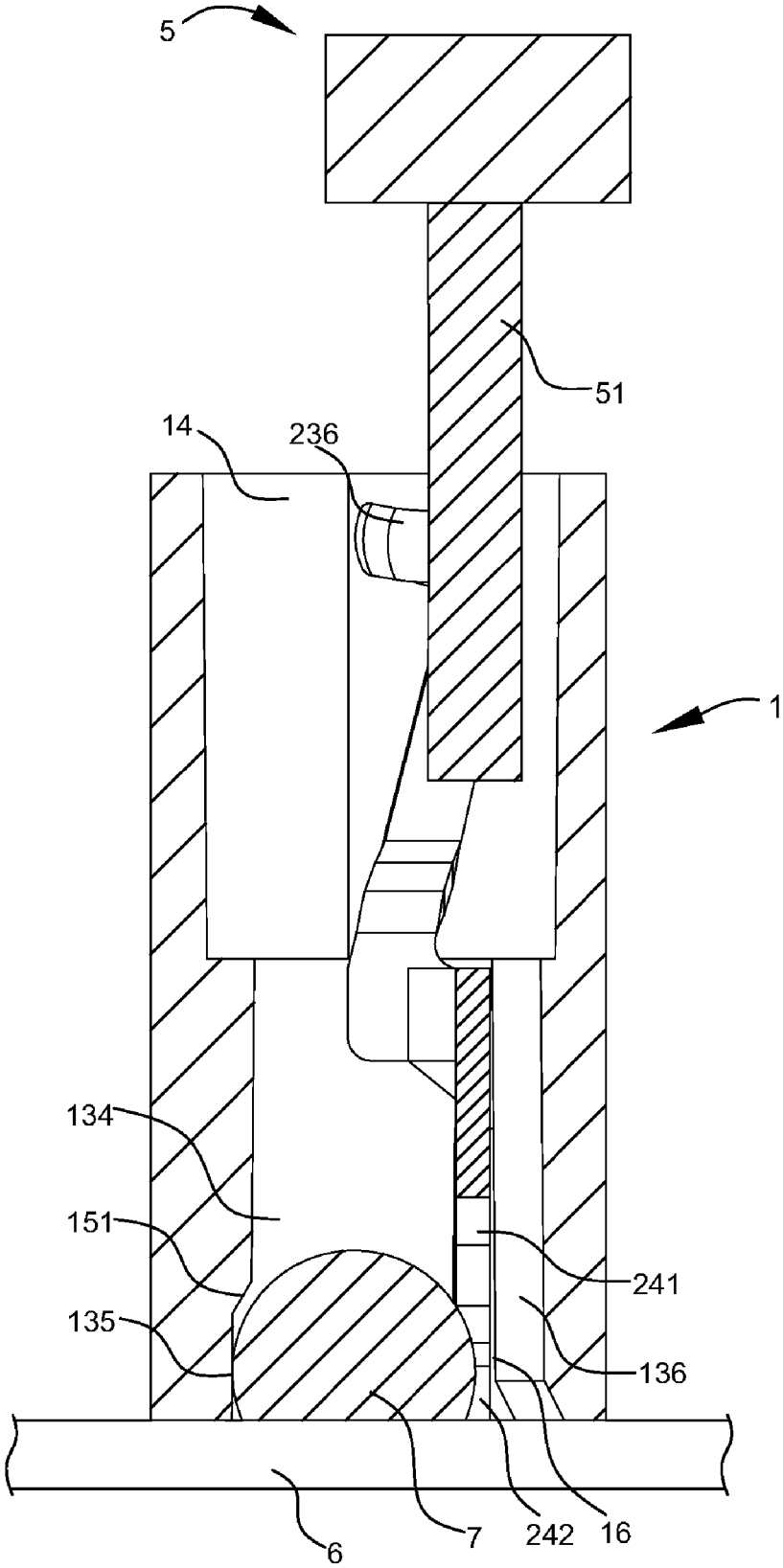
FIG. 7 is a cross sectional view along an A-A line of an electrical connector of the embodiment in FIG. 4.

Refer from FIG. 6 & FIG. 7, the conductive terminal 2 is assembled and is fixed in the terminal receiving slot 13 of the insulative body 1 so that the fixing part 25 is locked and is held in the fixing slot 16 of the insulative body 1. The projecting block 14 prevents the guiding part 236 moving toward the first side wall 131.

Also refer to FIG. 6 & FIG. 7, a solder ball 7 is riveted into the terminal receiving slot 13 through the lower surface 12 so as to be welded with the circuit board 6. The solder ball 7 is located under the stopping part 15 and the stopping surface 151 blocks the solder ball 7 to move upward. Moreover, the solder ball 7 is located between the two elastic pressing parts 242 of the welding part 24 and the leaning surface 135. Now a retaining force is generated from the solder ball 7 toward the two elastic pressing parts 242 so that the two elastic pressing parts 242 have elastic deformation and partially enter the buffering space 136. Thus the elasticity of the two elastic pressing parts 242 is increased. Yet the buffering space 136 provides a releasing space for the deformation of the two elastic pressing parts 242 so as to release the retaining force of the solder ball 7 toward the elastic pressing parts 242.

Back to FIG. 5, the top cover 3 is arranged on the insulative body 1 slidingly and horizontally so as to load the chip module 5. The top cover 3 is arranged with the plurality of insertion holes 33 (part shown in figure) corresponding to each terminal receiving slot 13 to allow the passage of the pins 51 (part shown in figure) and electrical connection of the pins 51 with the conductive terminals 2 (part shown in figure).

Refer to FIG. 5 & FIG. 6, the driving member 4 is assembled with the insulative body 1 and the top cover 3 so as to drive the top cover 3 sliding horizontally along the insulative body 1. And the terminal receiving slots 13 of the insulative body correspond to the insertion holes 33 of the top cover 3. When the pin 51 inserts into the insertion hole 33, the pin 51 moves from the guiding part 236 toward the contact surface 2351, enters between the two contact sections 235 of the conductive terminal 2, contacts the contact surface 2351 and extends between the two first elastic arms 233, and further between the two second bending parts 232. The pin 51 doesn't contact with the first elastic arm 233 as well as the second bending part 232. Thus the good electrical connection between the chip module 5 and the circuit board 6 is ensured while the pin 51 contacting and connecting with the conductive terminal 2 in the terminal receiving slot 13.

In other embodiments, the following conditions happen:

1. The base 21 is in the same plane as the fixing part 25 but not the welding part 24. The welding part 24 can be various forms as along as it can connect and contact the circuit board 6 well while being welded with the solder ball 7. Therefore, the bending procedure is reduced, the processing and stamping of the product are simplified, the efficiency is increased and the cost is reduced.
2. The base 21 is in the same plane as the welding part 24 but not the fixing part 25. The fixing part 25 can be various forms as along as it can make the conductive terminal 2 hold and fix in the insulative body 1. Therefore, the bending procedure is reduced, the processing and stamping of the product are simplified, the efficiency is increased and the cost is reduced.

In summary, the socket terminal of the present invention has the following effects:

1. The minimum distance between the two fixing parts 25 and that of the two second bending parts 232 are both larger than the minimum distance between the two connection parts 22 as well as that of the two contact sections 235. Thus damages of the pins of the chip module and of the conductive terminals can be avoided. Therefore, a better electrical connection is achieved. Moreover, the arched slot 2352 of the contact section 235 can also prevent damages of the pins and conductive terminals caused by sharp edges of the contact surface 2351.
2. The bending member 2311, the second elastic arm 2312 and the second bending part 232 on each arm are all bent and extended in the direction that is away from the other arm while the first elastic arm 233, the third bending part 234 are extending and bent in the direction toward the other arm. Thus the elasticity and strength of the conductive terminal 2 are improved and the conductive terminal 2 will not make the pin 51 bend and deform. Furthermore, the clip-retaining strength of the contact section 235 toward the pin is increased so that hold and contact between the conductive terminal and the pin 51 of the chip module become better.
3. The distance between the central lines of the two contiguous terminals on a material band is the same with the distance between the central lines between the two terminal receiving slots of the socket terminal for receiving the terminal. Thus the material is saved and the assembling of the conductive terminals is more convenient and easier.
4. When the fixing part 25, the welding part 24 and the base 21 are all in the same plane, the processing procedures such as bending are reduced. Thus stamping and processing of products are simplified. Therefore, the efficiency is improved and the cost is reduced. Similarly, other conditions such as only the base 21 and the fixing part 25 are in the same plane, or only the base 21 and the welding part 24 are in the same plane, or only the fixing part and the welding part are in the same plane can also achieve the same effects.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An electrical socket terminal for grid array connector comprising:

an insulative body having a plurality of terminal receiving slots defined therethrough;

a top cover having a plurality of insertion holes passing therethrough and being slidable over the insulative body;

a driving member that drives the top cover to slide along the insulative body and make the terminal receiving slots correspond to the insertion holes; and a plurality of conductive terminals respectively received in the corresponding plurality of the terminal receiving slots;

each conductive terminal includes a base that is mounted in the terminal receiving slot, and two connection parts respectively extending forwardly from two sides of the base, and a pair of arms respectively bent from one side of the connection part and extending upward while each arm includes a first bending part bent extending upwardly from the connection part and extending away from the other arm, a second bending part bent upwardly and extending from the first bending part, a first elastic arm extending upwardly from the second bending part and toward the other arm, a contact section formed at a rear end of the first elastic arm and toward the other contact section of the other arm, and a guiding part formed at a rear end of the contact section, extending forward horizontally away from the base, while the two guiding parts extend away from from each other;

a welding part extending downwardly from the base and having an open slot so as to form two elastic pressing parts while the welding part is in the same plane as the base; and at least one fixing part extending from the welding part, received and fixed in the terminal receiving slot, and the fixing part is in the same plane as the welding part.

2. The socket terminal as claimed in claim 1, wherein a fixing slot is disposed at one end of the terminal receiving slot so as to fix the fixing part in the fixing slot.

3. The socket terminal as claimed in claim 1, wherein a receiving space is formed at one end of the terminal receiving slot so as to receive a solder ball that is located on the welding part.

4. The socket terminal as claimed in claim 3, wherein a leaning surface is formed on one side of the receiving space for leaning of the solder ball and the other side of the receiving space is a stopping part located above the solder ball for preventing the solder ball moving upward; a buffering space is a concave area a side surface of the receiving space opposite to the leaning surface, and part of the two elastic pressing parts enters the buffering space while being pressed and deformed.

5. The socket terminal as claimed in claim 1, wherein a projecting block is disposed at the other end of the terminal receiving slot 13, on one side away from the contact section for blocking the guiding part of the conductive terminal.

6. The socket terminal as claimed in claim 1, wherein the first bending part further includes a bending member and a second elastic arm extending upwardly from the bending member while the bending member and second elastic arm are extending in a direction away from the other arm.

7. The socket terminal as claimed in claim 1, wherein the minimum width between the two fixing parts is larger than the minimum distance between the two second bending parts, the minimum distance between the two second bending parts is larger than the distance between the two connection parts, and the distance between the two connection parts is larger than the minimum distance between the two contact sections.

8. The socket terminal as claimed in claim 1, wherein the minimum width between the two fixing parts is larger than the minimum distance between the two second bending parts, the minimum distance between the two second bending parts is larger than the minimum distance between the two contact sections, and the minimum distance between the two contact sections is larger than the distance between the two connection parts.

9. The socket terminal as claimed in claim 1, wherein a third bending part is bent upwardly from the first elastic arm and toward the other arm while the third bending part connects the first elastic arm with the contact section.

10. The socket terminal as claimed in claim 1, wherein a contact surface is located on one side of the contact section that faces the other contact section while an arched slot is formed on the other side of the contact section.

11. The socket terminal as claimed in claim 10, wherein a free end of each of the two contact surfaces extends in the direction away from each other.

12. A socket terminal for grid array connector comprising:

an insulative body having a plurality of terminal receiving slots defined therethrough;

a top cover having a plurality of insertion holes passing therethrough and being slidable over the insulative body;

a driving member that drives the top cover to slide along the insulative body and make the terminal receiving slots correspond to the insertion holes; and a plurality of conductive terminals respectively received in the corresponding plurality of the terminal receiving slots and each conductive terminal having a base mounted in the corresponding terminal receiving slot;

a pair of arms respectively bent from two sides of the base and extending upwardly and each arm includes a connection part extending forwardly from the side of the base, a first bending part bent extending upwardly from the connection part and away from the other arm, a second bending part bent upwardly from the first bending part, a first elastic arm extending upwardly from the second bending part and toward the other arm, a contact section formed at a rear end of the first elastic arm and toward the other contact section of the other arm, and a guiding part formed at a rear end of the contact section, extending forward horizontally away from the base, while the two guiding parts extend away from each other;

a welding part extending downwardly from the base and having an open slot so as to form two elastic pressing parts while the welding part is in the same plane as the base, and at least one fixing part extending from the welding part, being received and fixed in the terminal receiving slot.

13. The socket terminal as claimed in claim 12, wherein the first bending part further includes a bending member and a second elastic arm extending upwardly from the bending member while the bending member and second elastic arm are extending in a direction away from the other arm.

14. The socket terminal as claimed in claim 12, wherein the minimum width between the two fixing parts is larger than the minimum distance between the two second bending parts, the minimum distance between the two second bending parts is larger than the distance between the two connection parts, and the distance between the two connection parts is larger than the minimum distance between the two contact sections.

15. The socket terminal as claimed in claim 12, wherein the minimum width between the two fixing parts is larger than the minimum distance between the two second bending parts, the minimum distance between the two second bending parts is larger than the minimum distance between the two contact sections, and the minimum distance between the two contact sections is larger than the distance between the two connection parts.

16. The socket terminal as claimed in claim 12, wherein a third bending part is bent upwardly from the first elastic arm and toward the other arm while the third bending parts connect the first elastic arm with the contact section.

17. The socket terminal as claimed in claim 12, wherein a contact surface is located on one side of the contact section that faces the other contact section while an arched slot is formed on the other side of the contact section.

18. The socket terminal as claimed in claim 17, wherein a free end of each of the two contact surfaces extends in the direction away from each other.

19. A socket terminal for grid array connector, and connecting chip modules with circuit boards, comprising:

an insulative body having a plurality of terminal receiving slots defined therethrough;

a top cover having a plurality of insertion holes passing therethrough and being slidable over the insulative body;

a driving member that drives the top cover to slide along the insulative body and make the terminal receiving slots correspond to the insertion holes; and a plurality of conductive terminals respectively received in the corresponding plurality of the terminal receiving slots and each conductive terminal having a base mounted in the corresponding terminal receiving slot;

a pair of arms respectively bent from two sides of the base and extending upwardly and each arm includes a connection part extending forwardly from the side of the base, a first bending part bent extending upwardly from the connection part and away from the other arm, a second bending part bent upwardly from the first bending part, a first elastic arm extending upwardly from the second bending part and toward the other arm, a contact section formed at a rear end of the first elastic arm and toward the other contact section of the other arm, and a guiding part at a rear end of the contact section, extending forward horizontally away from the base, while the two guiding parts extending in opposite directions, away from each other;

a welding part extending downwardly from the base and having an open slot so as to form two elastic pressing parts, and at least one fixing part extending from the welding part, received and fixed in the terminal receiving slot, and the fixing part is in the same plane as the base.

20. The socket terminal as claimed in claim 19, wherein the first bending part further includes a bending member and a second elastic arm extending upwardly from the bending member while the bending member and second elastic arm are extending in a direction away from the other arm.

21. The socket terminal as claimed in claim 19, wherein the minimum width between the two fixing parts is larger than the minimum distance between the two second bending parts, the minimum distance between the two second bending parts is larger than the distance between the two connection parts, and the distance between the two connection parts is larger than the minimum distance between the two contact sections.

22. The socket terminal as claimed in claim 19, wherein the minimum width between the two fixing parts is larger than the minimum distance between the two second bending parts, the minimum distance between the two second bending parts is larger than the minimum distance between the two contact sections, and the minimum distance between the two contact sections is larger than the distance between the two connection parts.

23. The socket terminal as claimed in claim 19, wherein a third bending part is bent upwardly from the first elastic arm and toward the other arm while the third bending part connects the first elastic arm with the contact section.

24. The socket terminal as claimed in claim 19, wherein a contact surface is located on one side of the contact section that faces the other contact section while an arched slot is formed on the other side of the contact section.

25. The socket terminal as claimed in claim 24, wherein a free end of each of the two contact surfaces extends in the direction away from each other.

* * * * *